US005719359A

United States Patent [19]

Wolf et al.

[11] Patent Number: 5,719,359

[45] Date of Patent: Feb. 17, 1998

[54] LAMINAR DAMPER

[75] Inventors: Franz-Josef Wolf, Bad Soden-Salmunster; Nenad Cvjeticanin, Frankfurt am Main, both of Germany

[73] Assignee: WOCO Franz-Josef Wolf & Co., Bad Soden-Salmunster, Germany

[21] Appl. No.: 437,770

[22] Filed: May 9, 1995

[30] Foreign Application Priority Data

May 9, 1994 [DE] Germany ..... 44 16 361.4

[51] Int. Cl.[6] ..... E04B 1/82

[52] U.S. Cl. ..... 181/286; 181/200

[58] Field of Search ..... 181/200, 202, 181/205, 286, 204, 290, 293, 295

[56] References Cited

U.S. PATENT DOCUMENTS 2,534,137 12/1950 Lewis ..... 181/208

2,989,136 6/1961 Wohlberg ..... 181/286

4,821,841 4/1989 Woodward et al. ..... 181/286

4,842,097 6/1989 Woodward et al. ..... 181/286

5,512,715 4/1996 Takewa et al. ..... 181/286 X

*Primary Examiner*—Khanh Dang

*Attorney, Agent, or Firm*—Lowe, Price, LeBlanc & Becker

[57] ABSTRACT

A damper for acoustic waves propagating in particular in a gaseous medium comprises a plurality of vibrational bodies including a plurality of laminas mounted substantially parallel and adjacent to one another. The plurality of laminas are mounted in a housing to form a free space between the upper and/or lower sides of the housing. The laminas vibrate within the free space to dissipate the energy from the acoustic waves.

9 Claims, 1 Drawing Sheet

LAMINAR DAMPER

FIELD OF THE INVENTION

The present invention relates to an apparatus for damping acoustic waves propagating in particular in a gaseous medium.

BACKGROUND OF THE INVENTION

It is known and proven that noise negatively affects people in many ways. Accordingly much care is expended to reduce noise.

In general a distinction is made in industrially generated or transmitted noise between solid-propagated and air-propagated noise. Solid-propagated noise is, for instance, caused by imbalanced, rotating machine parts and is present almost without exception in any translational or rotational motion of mass sources. Thus, solid-propagated noise is virtually unavoidable. Such vibrations are transmitted from the periphery of, for instance, internal-combustion engines, turbine wheels or blowers, in the form of acoustic waves into the ambient air.

These acoustic waves carry energy in this air-filled and hence acoustically transmitting medium.

This energy inherent in such longitudinal waves must be lowered or converted into another form of energy to reduce the acoustic level sensed by humans. Devices which are on one hand inhibiting and on the other hand damping are known in the art for such purposes. Among the known prior art dampers are so-called absorbing dampers which absorb the energy of vibration carried by the acoustic waves and convert it into heat. These absorbing dampers are also known as dissipative acoustic dampers and are comparatively broad-band in their operation.

A plurality of foams or fiber materials such as mineral-wool mats or felt mats are known in this field to act as traps to absorb the acoustic energy.

The above dampers are resonators in the form of so-called impedance dampers. These dampers do not absorb the acoustic energy but instead reflect it. This requires that the dampers be tuned to the particular acoustic frequencies. The drawback of this type of dampers is the requirement that they be tuned to the specific frequencies of the particular applications. Thus, they cannot be applied universally.

Absorbing dampers, for instance in the form of mineral-wool mats or felt mats, are frequently used in air conditioning where such devices may be integrated into the air ducts so that the associated blower noises, the flow noises in the duct circuits or at corners, turns, constrictions, grilles, and the noise attributable to high air speeds, can be absorbed.

It is known that such mineral wool mats represent a health danger because they ordinarily emit very fine particles that may fixate themselves in the human respiratory tract. This is obviously undesirable. If illustratively these absorbing dampers are used for noise reduction in motor vehicles, then they are exposed to soiling by oil, water, dust and the like which ultimately may destroy them or may reduce damping by clogging the open-pore materials. This condition is also found in the foam frequently employed for such purposes, for instance, polyurethane foam.

In the light of the above state of the art, it is the object of the present invention to provide an improved apparatus with which to dampen acoustics.

Another object of the present invention is to provide an improved damping apparatus which is both effective and economical.

A further object of the present invention is to provide an improved damping apparatus which is widely applicable.

SUMMARY OF THE INVENTION

According to the present invention, an apparatus is provided to dampen acoustic waves propagating in a medium, in particular a gaseous medium. The apparatus comprises a plurality of vibrational bodies, i.e., bodies which can be set in vibration.

Accordingly, the basic concept of the invention is to use a number of particular vibrational bodies which are impacted by the acoustic waves propagating in the gaseous medium. These acoustic waves drive the particular vibrational bodies, as a result of which at least part of the acoustic wave energy is converted into kinetic energy in the bodies. This kinetic energy is converted into heat on account of internal friction, i.e. molecular collision, in the bodies, or as a result of the bodies rubbing against one another, or by a mixture of such frictional states.

Moreover, because the particular vibrational bodies are enclosed by the gaseous medium making possible the propagation of the acoustic waves, the individual molecules of the gaseous medium are set into a state of internal friction. Furthermore, these molecules will rub against the vibrational bodies and the bodies will also rub against each other.

Clearly, the acoustic waves from a noise source impact the surfaces and thus drive into vibration the plurality of vibrational bodies. Hence, intensive friction is generated in the vibrational bodies and in the gaseous medium enclosing them, whereby the acoustic energy is converted into heat and into kinetic energy imparted to the vibrational bodies. The result is a lowering of the noise level of the acoustic waves emitted into free space.

The invention provides that the vibrational bodies essentially be adjoining laminas disposed substantially parallel to one another. This design enhances the friction of the individual vibrational bodies, i.e., of the laminas against each other.

Advantageously the laminas are oblong, whereby a maximally large rubbing surface between the individual laminas is achieved.

The laminas may be integrated to form a sub-assembly of individually vibrational laminas. This lamina sub-assembly is easily manufacturable and illustratively is rectangular in top view, the particular laminas accordingly being joined to each other along the oblong outer periphery of the sub-assembly while being free to vibrate inside the rectangle, whereby they can rub against one another along the longitudinal sides so formed.

In a further embodiment of the invention, the laminas are so mounted in a housing that a slight free space is formed either below or also above as well as on both sides of the lamina sub-assembly between it and the upper and/or lower side of the housing, and the laminas may vibrate within this space without hitting the housing.

In a further development of the invention, a medium, in particular a gaseous medium, may be present between the laminas and the upper and/or lower sides of the housing, the medium damping the vibrations of the laminas.

Illustratively this medium may be air to dampen the lamina vibrations. During the vibrations, the air flows through the gaps between the laminas opened during vibration, whereby intensive flow of the air molecules takes place in the gaps in such manner that the acoustic-wave energy transferred to the laminas is converted into kinetic energy which is converted by the flow of the air molecules as well as by the associated friction finally into heat and thus is dissipated.

In the invention, the aforementioned free space preferably shall be of a height somewhat greater than 5 mm. This selection ensures both that the appropriately designed laminas do not hit the upper and/or the lower sides of the housing when vibrating and also that an air space of adequate size to act as a cushion shall be formed in the above free space.

Preferably the particular laminas are 5 to 10 mm wide and are of a cross-sectional height each between 1.5 and 2 mm approximately. As a result the particular laminas are both vibrational and somewhat rigid.

In a further embodiment of the invention, at least two lamina sub-assemblies, each preferably integral and comprising individually vibrational laminas, may be mounted in a substantially superposed manner such that the laminas of the individual sub-assemblies cross at a specified angle.

This design is such that, when for instance using a cross-sectionally square housing, a first lamina sub-assembly is present inside the housing and a second lamina sub-assembly is mounted on top of the first one so that the second sub-assembly rests substantially on the first in such a manner that the laminas of the particular lamina sub-assemblies cross at an angle. It is to be noted that the angle of crossing is not critical. For instance, if three lamina assemblies are being used, one above the other, the individual laminas of the particular lamina sub-assemblies may cross at an angle of 90°.

In a further development of the invention, the damper comprises a plurality of individual and preferably integral lamina sub-assemblies, each comprising particular vibrational laminas in such a manner that the lamina sub-assemblies are substantially adjacent to form a unit assembly. In other words, a unit assembly may be implemented which comprises adjacent dampers of the invention to create a large area of vibration-damping laminas in the form of a plurality of sub-assemblies.

The damper of the invention moreover may evince an outer contour matchable to arbitrary applications. For instance, a top view rectangular damper may be created, or a damper with a hollow-cylindrical design illustratively enclosing an automobile electric motor, or the damper may assume the shape of an arc of circle around part of an alternator in the engine compartment.

The laminas of the invention are made by plastic injection molding. The selection of materials is not of primary importance, and is mainly dependent upon environmental considerations, such as the temperature of the environment in which the damper is to be installed. A recycled material may be used for such purposes; thus, the damper may be highly economical.

Accordingly, the invention comprises a plurality of vibrational bodies to dampen acoustic waves propagating, in particular, in a gaseous medium.

The invention also provides a method for damping acoustic waves propagating, in particular, in a gaseous medium wherein a plurality of individually vibrational bodies dissipates the acoustic-wave energy by internal friction in the bodies and/or by the friction between the medium and the vibrational bodies and/or by internal medium friction.

An exceedingly economical acoustic damper is thereby made available, which comprises sound-reducing laminas in lieu of the conventional sound barriers fitted with fibers or foams. Besides the cited economy, the damper of the invention furthermore offers the advantage that the plastic laminas are re-usable and provide soil resistance relative to water, oil and dust, without degrading the noise-reduction properties. The parallel laminas may be fitted at their peripheries with a frame and be mounted as a compact set inside a housing, for instance an acoustic hood. For automobiles, such a system might be mounted between the trunk and the passenger space.

An air cushion is provided between the laminas and the acoustic hood to dampen the vibrational displacement of the laminas and to contribute to energy dissipation.

The noise-source generated acoustic waves impact the damper surface and thereby set the laminas in vibration. As a result, intensive friction results between the laminas and the air molecules passing through them, the acoustic energy thereby being converted into heat and also into kinetic energy of the laminas, whereby the sound level of the acoustic waves radiated into the free space is significantly lowered.

The invention is elucidated below in relation to the drawing.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
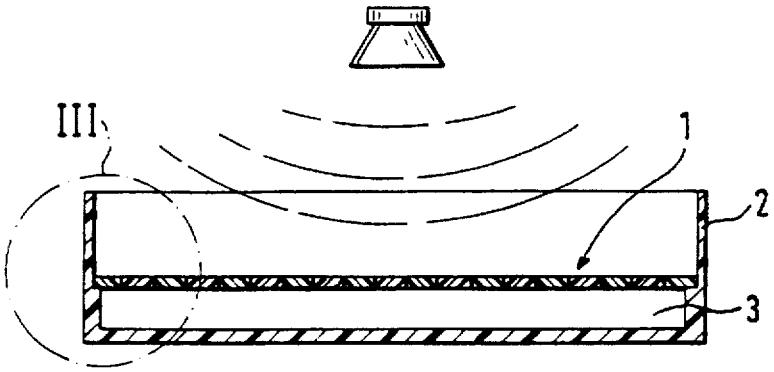
FIG. 1 is a schematic cross-section of an embodiment of a damper according to the present invention.

As shown by FIG. 1, a first embodiment of the damper of the present invention comprises a lamina sub-assembly 1, a housing 2 and a free space 3.

Figure 2:
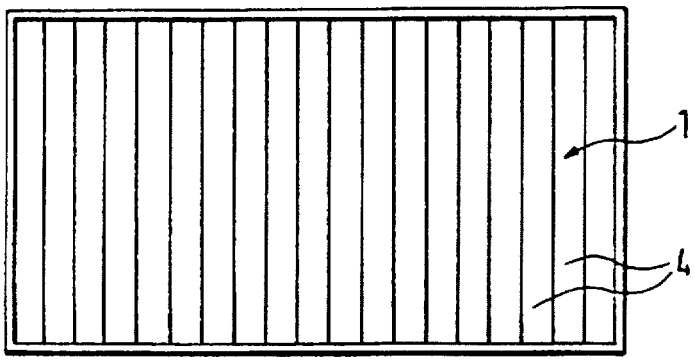
FIG. 2 is a top view of the embodiment of FIG. 1.
Figure 3:
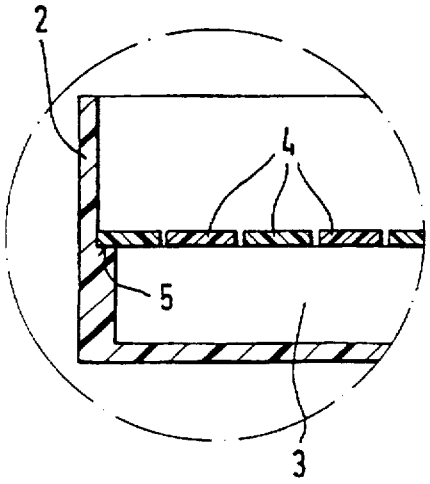
FIG. 3 is an enlarged detailed view of section "X" of FIG. 1.

As shown in more detail in FIG. 2, lamina sub-assembly 1 preferably assumes a top view rectangular shape with a plurality of mutually parallel and abutting laminas 4 (FIG. 3). In the shown embodiment, the lamina sub-assembly is mounted in a tub-shaped housing 2 in such manner that a free space 3 is subtended in the housing 2. The lamina sub-assembly 1 comprises a plurality of particular laminas 4 running parallel to each other by their longitudinal sides and integral with one another at their particular opposite ends. Thus, the lamina sub-assembly 1 so created is easily insertable or formable into the housing 2.

As shown by FIG. 3, the damper comprises an offset 5 at the housing 2 in the region of the support site of the lamina sub-assembly 1, the offset adapted to receive the sub-assembly. Lamina sub-assembly 1 may be made integral, for instance, by injection molding, and may be inserted from above into the box-shaped housing 2 so that its outer periphery comes to rest on the offset 5. When lamina sub-assembly 1 is so inserted, free space 3 remains below the lamina sub-assembly 1 in the housing 2, the free space, for instance, being filled with a gaseous medium such as air.

If, as indicated in FIG. 1 by the schematic loudspeaker, acoustic waves impact lamina sub-assembly 1, then the particular laminas 4 are set in vibration and vibrate along their particular longitudinal directions, so that gaps are created between the particular laminas and are crossed by the air in the free space 3 flowing along the longitudinal sides of the particular laminas 4. As a result, the energy transmitted by the acoustic waves is converted into kinetic energy in the particular laminas 4 and internal friction of the air molecules in the free space 3 and friction of the air molecules from the free space 3 at the longitudinal sides of the particular laminas. The transmitted acoustic wave energy is dissipated.

Figure 4:
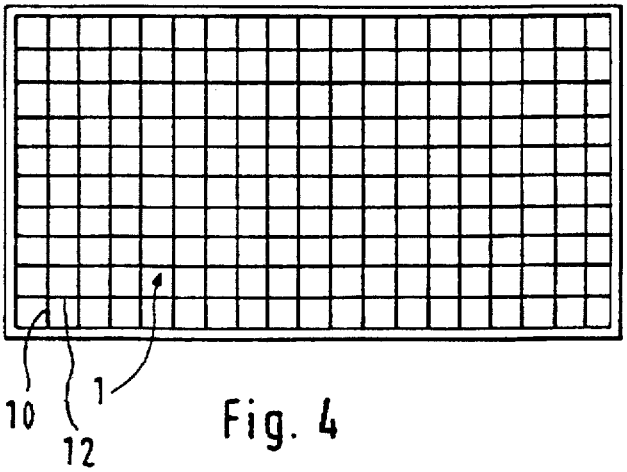
FIG. 4 is a top view of a second embodiment of the damper of the invention.

FIG. 4 shows a second embodiment, wherein the lamina sub-assembly 10, as described with reference to the embodiment of FIG. 2, is deposited from above on a second lamina sub-assembly 12, resulting in the unit assembly shown merely for clarity in FIG. 4.

Particular features of the invention that were not discussed further above will be stated in the drawings and found in the claims.

Although the present invention has been described and illustrated in detail, it is clearly understood that the same is by way of illustration and example only and is not to be taken by way of limitation, the spirit and scope of the present being limited only by the terms of the appended claims.

What is claimed is:

1. An apparatus for damping acoustic waves propagating in a gaseous medium, comprising:

a housing; and a vibration body mounted to the housing in spaced relation from a surface of the housing to form a free space therebetween, the vibration body comprising a plurality of laminas mounted generally parallel and adjacent to one another to form an integral sub-assembly, wherein each of the plurality of laminas is individually vibrational; and wherein the vibration body is mounted to the housing only at a periphery thereof such that the free space extends continuously between the plurality of laminas of the vibration body and the surface of the housing.

2. Apparatus according to claim 1, wherein each lamina is oblong with a length being greater or at least equal to a width thereof.

3. Apparatus according to claim 1, wherein a gaseous medium for damping vibrational displacement of the laminas is present in the free space between the laminas and the upper and lower side of the housing.

4. Apparatus according to claim 3, wherein the gaseous medium is air.

5. Apparatus according to claim 1, wherein the height of the free space preferably is larger than 5 mm.

6. Apparatus according to claim 1, wherein the width of each lamina is in the range of 5 to 10 mm and a cross-sectional height thereof is in the range of 1.5 to 2 mm.

7. Apparatus according to claim 1, further comprising at least two substantially superposed said sub-assemblies, each integral and comprising individually vibrational laminas wherein the laminas of the sub-assemblies cross each other at an angle.

8. Apparatus according to claim 1, wherein the outer contour of the apparatus conforms with a predetermined application.

9. Apparatus according to claim 1, wherein the laminas are made of injection-molded plastic.

* * * * *